United States Patent [19]

Ricketts

[11] Patent Number: 4,458,948

[45] Date of Patent: Jul. 10, 1984

[54] HORIZONTAL FREE FACE BLASTING FOR MINIMIZING CHANNELING AND MOUNDING IN SITU RETORT WITH CUSP AT INTERMEDIATE ELEVATION

[75] Inventor: Thomas E. Ricketts, Grand Junction, Colo.

[73] Assignee: Occidental Oil Shale, Inc., Grand Junction, Colo.

[21] Appl. No.: 478,712

[22] Filed: Mar. 25, 1983

Related U.S. Application Data

[62] Division of Ser. No. 227,588, Jan. 23, 1981, Pat. No. 4,396,231.

[51] Int. Cl.[3] ..... E21C 41/10

[52] U.S. Cl. ..... 299/19

[58] Field of Search ..... 299/19, 13, 2; 102/312

[56] References Cited

U.S. PATENT DOCUMENTS

| | | | |
|---|---|---|---|
| 3,236,053 | 2/1966 | Billue | 299/2 X |
| 3,342,257 | 9/1967 | Jacobs et al. . | |
| 3,586,377 | 6/1971 | Ellington . | |
| 4,181,362 | 1/1980 | Burton | 299/2 |
| 4,243,100 | 1/1981 | Cha | 299/13 X |

OTHER PUBLICATIONS

Redpath, "Applic. of Cratering Char. to Conv. Blast Design", Soc. of Min. Eng. & Am. Inst. of Min., Met. & Pet. Eng., 1977.

*Primary Examiner*—Ernest R. Purser

*Attorney, Agent, or Firm*—Christie, Parker & Hale

[57] ABSTRACT

There is provided a method for forming an in situ retort containing a fragmented permeable mass of formation particles in a retort site within a subterranean formation. A void is excavated into the formation and a zone of unfragmented formation is left adjacent the void. A plurality of explosive charges are formed in the zone of unfragmented formation. At least one central explosive charge is in a central portion of the zone of unfragmented formation, and a plurality of outer explosive charges are in the zone of unfragmented formation nearer the side walls of the void than the central explosive charge. The distance from each such outer explosive charge to an adjacent side wall of the void is about equal to the crater radius of the outer explosive charge. The central and outer explosive charges are detonated for explosively expanding the zone of unfragmented formation toward the void for forming a fragmented permeable mass of formation particles in the in situ retort. The retort has a horizontal cross-sectional area at an intermediate elevation which is less than the horizontal cross-sectional area of the retort at elevations above and below the intermediate elevation.

2 Claims, 5 Drawing Figures

HORIZONTAL FREE FACE BLASTING FOR MINIMIZING CHANNELING AND MOUNDING IN SITU RETORT WITH CUSP AT INTERMEDIATE ELEVATION

CROSS REFERENCE TO RELATED APPLICATIONS

This is a division of application Ser. No. 277,588, filed Jan. 23, 1981 and now U.S. Pat. No. 4,396,231.

FIELD OF THE INVENTION

This invention relates to the formation of an in situ oil shale retort containing a fragmented permeable mass of formation particles in a retort site within a subterranean formation. More particularly, this invention relates to a method of expanding a zone of unfragmented subterranean formation within a retort site toward a void within the formation to thereby form a fragmented permeable mass of formation particles having a reasonably uniform distribution of void fraction.

BACKGROUND OF THE INVENTION

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents such as U.S. Pat. Nos. 3,661,423; 4,043,597; 4,043,598; and 4,192,554; and in U.S. patent application Ser. No. 070,319 filed Aug. 27, 1979, by Chang Yul Cha, entitled TWO-LEVEL, HORIZONTAL FREE FACE MINING SYSTEM FOR IN SITU OIL SHALE RETORTS. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted ol shale. One method of supplying hot retorting gases used for converting kerogen contained in the oil shale as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas withdrawn from the retort can include carbon dioxide generated in the combustion zone, gaseous products produced in the retorting zone, carbon dioxide from carbonate decomposition, and any gaseous retort inlet mixture that does not take part in the combustion process.

U.S. Pat. Nos. 4,043,597; 4,043,598; and 4,192,554 disclose methods for explosively expanding formation containing oil shale toward horizontal free faces to form a fragmented mass in an in situ oil shale retort. According to such a method, a plurality of vertically spaced apart voids of similar horizontal cross-section are initially excavated one above another within the retort site. A plurality of vertically spaced apart zones of unfragmented formation are temporarily left between the voids. A plurality of horizontally spaced apart vertical columnar explosive charges, i.e., an array of explosive charges, is placed in each of the unfragmented zones and detonated to explosively expand each unfragmented zone upwardly and/or downwardly towards the void or voids above and/or below it to form a fragmented mass having an average void volumne about equal to the void volume of the initial voids. Retorting of the fragmented mass is then carried out to recover shale oil from the oil shale.

U.S. patent application Ser. No. 070,319, incorporated above by reference, discloses a method for explosively expanding formation containing oil shale toward a horizontal free face to form a fragmented mass in an in situ oil shale retort. According to such a method, a void having a horizontal cross-section similar to the horizontal cross-section of the retort being formed is initially excavated. A plurality of vertically spaced apart zones of unfragmented formation are left above the void. Explosive is placed in each of the unfragmented zones and detonated for explosively expanded such zones toward the void to form a fragmented mass in the retort having an average void volume about equal to the void volume of the initial void. The overlying zones can be expanded toward the void in a single round or a plurality of rounds. Retorting of the fragmented mass is then carried out to recover shale oil from the oil shale.

It is desirable to have a generally uniformly distributed void fraction in the fragmented mass so that there is generally uniform permeability. Thus, oxygen-supplying gas and combustion gas can flow reasonably uniformly through the fragmented mass during retorting operations. A fragmented mass having generally uniform permeability avoids bypassing portions of the fragmented mass by retorting gas as can occur if there is gas channeling through the mass due to non-uniform permeability.

In the past, when using vertical columnar explosive charges for explosively expanding formation, some of the charges have been located close to the vertical walls of a void towards which expansion is directed. These charges are not free to crater toward the horizontal free face (i.e., upward or downward, as the case may be), but are confined on one side by the wall. Formation expanded by these charges is directed in some measure inwardly away from the walls and not entirely vertically, as desired. The fragmented mass formed by the expansion has an upper surface that is not flat, but is mounded, i.e., relatively high, at the center and lower at the side boundaries of the retort. This arrangement can also result in the fragmented mass having a higher void fraction along the side boundaries of the retort and a lower void fraction near its center. Having a fragmented mass with a higher void fraction along the side boundaries and a lower void fraction in about the center can result in gas channeling along the side boundaries and consequent reduction in the efficiency of the retorting process.

It is, therefore, desirable to provide an economical method for expanding formation toward a horizontal free face that enhances the uniformity of void fraction distribution of the resulting fragmented mass of formation particles.

SUMMARY OF THE INVENTION

This invention relates to a method for forming a fragmented permeable mass of formation particles in a cavity in a subterranean formation.

In an exemplary embodiment, the fragmented permeable mass of formation particles is formed in an in situ oil shale retort in a subterranean formation containing oil shale. A void bounded by zones of unfragmented formation above and below and by side walls of unfragmented formation around its perimeter is excavated in the subterranean formation. An array of horizontally spaced apart explosive charges is formed in at least one of the zones of unfragmented formation. The array of explosive charges comprises at least one central explosive charge in a central portion of such a zone and a plurality of outer explosive charges in such a zone intermediate the plane of a side wall of the void and such a central explosive charge. Preferably, the distance from each such outer explosive charge to the plane of an adjacent side wall of the void is about equal to the crater radius of the outer explosive charge. The central and outer explosive charges are detonated for explosively expanding the zone of unfragmented formation toward the void for forming a fragmented permeable mass of formation particles in an in situ oil shale retort. The in situ oil shale retort formed thereby has a horizontal cross-sectional area at an intermediate elevation which is less than the horizontal cross-sectional area of the retort at elevations above and/or below such an intermediate elevation.

DRAWINGS

These and other features, aspects, and advantages of the present invention will be more fully understood when considered with respect to the following detailed description, appended claims, and accompanying drawings wherein:

DETAILED DESCRIPTION

Although the exemplary embodiments of this invention are described in terms of forming a fragmented mass of formation particles containing oil shale in an in situ oil shale retort in a subterranean formation, practice of this invention can be used for forming a fragmented mass of formation particles in a cavity in any subterranean formation as desired.

Figure 1:
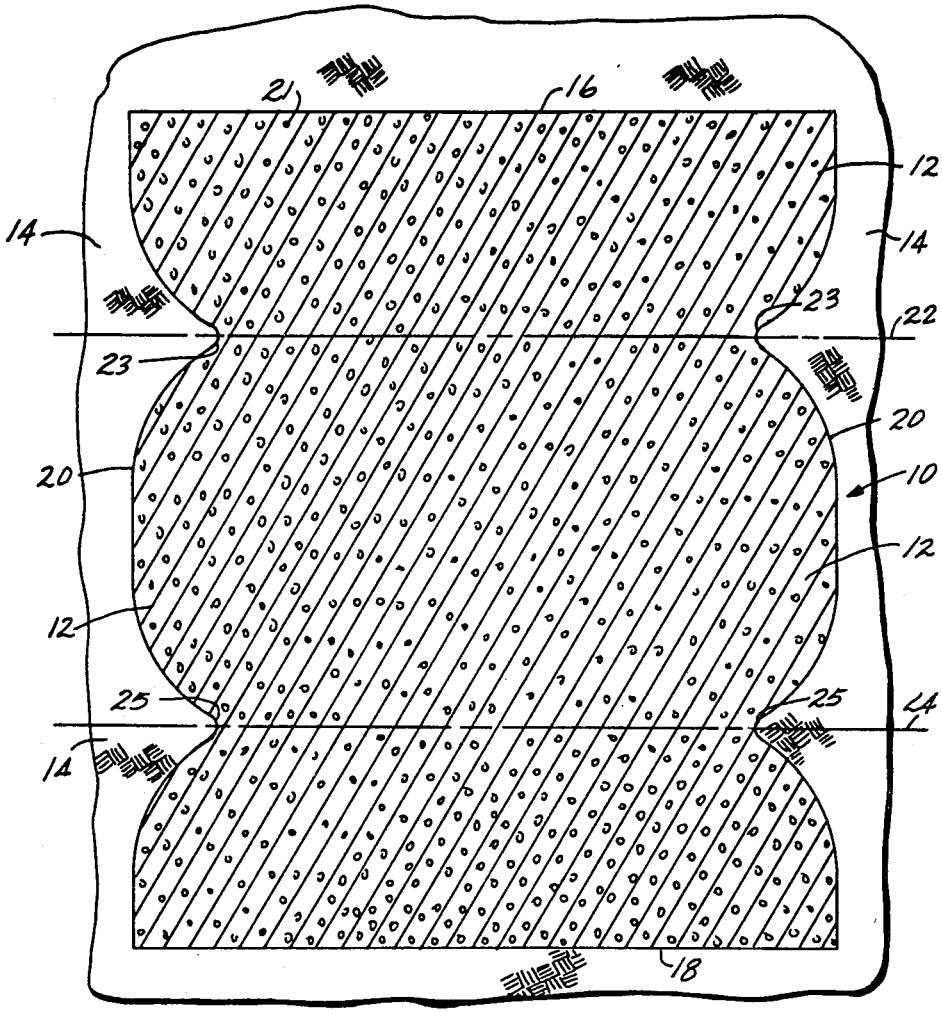
FIG. 1 is a semi-schematic vertical cross-sectional view of an in situ oil shale retort formed in accordance with practice of principles of this invention.

Referring to FIG. 1, there is shown a semi-schematic vertical cross-sectional view of an exemplary embodiment of an in situ oil shale retort 10 formed in accordance with practice of principles of this invention. The in situ oil shale retort contains a fragmented permeable mass of formation particles 12 and is in a subterranean formation 14 containing oil shale. The retort has a top boundary 16, a bottom boundary 18, and side boundaries 20 of unfragmented oil shale formation.

The horizontal cross-sectional area of the retort is not uniform along its height. For example, the retort has a narrow "waist" at one or more elevations. In this exemplary embodiment, the retort 10 has a narrow waist at two elevations; a first elevation shown by the phantom line 22 and a second elevation shown by the phantom line 24. The narrow waists at the first and second elevations in the retort 10 are formed by curved segments of unfragmented formation which, in this instance, are cuspidal-shaped segments 23 and 25 of the side boundaries of unfragmented formation which extend around the perimeter of the retort. When the fragmented mass does not fill the retort completely to the top boundary as in the exemplary retort 10, the upper surface 21 of the fragmented mass 12 is preferably substantially flat.

Although the retort 10 of this exemplary embodiment has a narrow waist at two elevations, retorts having a narrow waist at only one elevation or at more than two elevations can be formed in accordance with practice of this invention. Additionally, the narrow waist(s) can be formed at any desired elevation in the retort.

Figure 2:
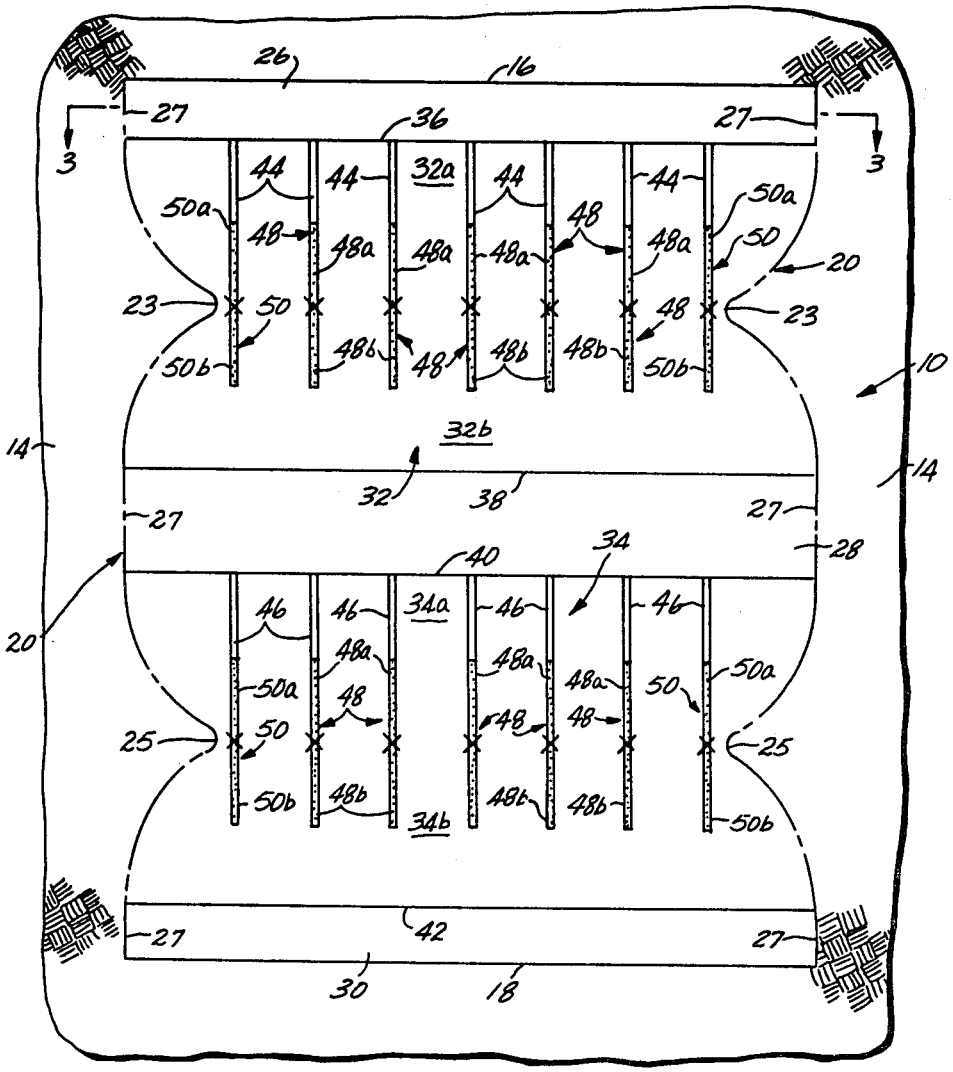
FIG. 2 is a semi-schematic vertical cross-sectional view of a subterranean formation at one stage during preparation for forming the retort illustrated in FIG. 1.
Figure 3:
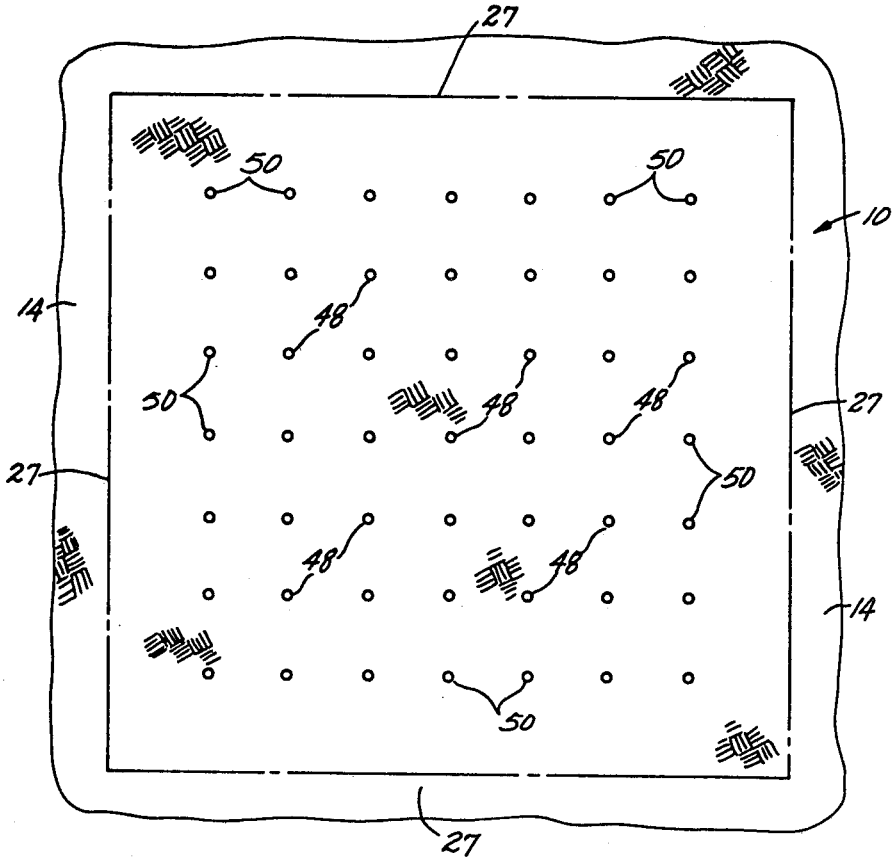
FIG. 3 is a horizontal cross-sectional view taken on line 3—3 of FIG. 2.

Details of forming the in situ oil shale retort 10 in accordance with this invention can be understood by referring to FIGS. 2 and 3 which are semi-schematic vertical and horizontal cross-sectional views of the subterranean formation 14 at one stage in the preparation of the retort.

In the exemplary embodiment, a generally horizontally extending upper void 26, a generally horizontally extending intermediate void 28, and a generally horizontally extending lower void 30 are excavated within the subterranean formation 14.

The roof of the upper void is the top boundary 16 and the floor of the lower void is the bottom boundary 18 of the retort 10 being formed. The voids are generally rectangular in horizontal cross-section and each void preferably has about the same horizontal cross-sectional area as each other void. However, voids having horizontal cross-sections other than rectangular can be excavated if desired and the voids may have different horizontal cross-sections if desired.

It is desired that the total volume of the excavated voids comprises at least about 15% and preferably from about 15% to about 45% of the total volume of the retort being formed.

The upper, intermediate, and lower voids are preferably within the same vertical planes, i.e., the voids are located one above the other and each pair of adjacent voids is separated vertically by a zone of unfragmented formation which extends therebetween. Thus, an upper zone of unfragmented formation 32 extends between the upper void 26 and the intermediate void 28. A lower zone of unfragmented formation 34 extends between the intermediate void 28 and the lower void 30. Each rectangular void is bounded by four generally vertically extending side walls 27 of unfragmented formation. The side walls of the voids extend around the perimeter of the retort being formed and form vertical portions of the side boundaries 20 of the retort site.

Explosive charges are placed into the upper and lower zones of unfragmented formation and the charges are then detonated for explosively expanding the unfragmented formation toward the voids for forming the fragmented permeable mass of formation particles 12 in the retort.

In the exemplary embodiment, an upper portion **32*a*, i.e., the upper half of the upper zone 32, is expanded upwardly toward a horizontally extending free face 36 which is the floor of the upper void. A lower portion 32*b*, i.e., the lower half of the upper zone, is expanded downwardly toward a horizontally extending free face 38 which is the roof of the intermediate void. In addition, an upper portion 34*a* of the lower zone 34 is expanded upwardly toward a horizontally extending free face 40, which is the floor of the intermediate void, and a lower portion 34*b* of the lower zone is expanded downwardly toward a horizontally extending free face 42**, which is the roof of the lower void.

If desired, retorts can be formed in accordance with this invention when only two voids are excavated into the formation and a zone of unfragmented formation left between the voids is expanded both upwardly toward the void above and downwardly toward the void below. It should be understood, however, that a retort can also be formed according to principles of the present invention when only one void is excavated into the formation and a zone of unfragmented formation is left above or below the void. In this instance, the zone of unfragmented formation can be expanded either in a single round toward the void or the zone can be expanded toward the void in a plurality of layers, either in a single round or in a plurality of separate rounds. Alternatively, retorts can be formed by excavating four or more voids into the formation.

If desired, one or more support pillars (not shown) can be left in each void for temporarily supporting overlying unfragmented formation while the zones of unfragmented formation are being prepared for explosive expansion. When pillars are left in the voids, they are explosively expanded prior to explosive expansion of the zones of unfragmented formation, preferably in the same round as the expansion of the zones of unfragmented formation or, if desired, in a separate round. The support pillars can be left at any location in the void as, for example, in the center of a void or along the edges of the void. Although pillars can extend along one or more edges of a void, the walls 27 of such a void are described herein and shown in the figures after any pillars extending along the edges have been removed.

In the exemplary embodiment, a plurality of substantially vertical, horizontally spaced apart blastholes 44 are drilled into the upper zone of unfragmented formation. The blastholes are generally perpendicular to the free faces 36 and 38 towards which the upper zone is to be explosively expanded.

Additionally, a plurality of substantially vertical, horizontally spaced apart blastholes 46 are drilled into the lower zone of unfragmented formation. The blastholes 46 are generally perpendicular to the free faces 40 and 42 towards which the lower zone of unfragmented formation is to be explosively expanded.

The blastholes 44 and 46 are shown out of proportion in the figures for clarity of illustration, i.e., the blastholes are actually much smaller in diameter relative to the formation than shown.

The upper and lower zones of unfragmented formation are prepared for explosive expansion by loading explosive into the blastholes 44 in the upper zone and into the blastholes 46 in the lower zone. Since the configuration of the array of blast-holes and the explosive charges in both the upper and lower zones in the exemplary embodiment are preferably the same, the description of blasthole patterns and configurations of explosive charges will, for simplicity, be limited to those in the upper zone.

After the blastholes 44 are drilled, explosive is loaded into the blastholes to thereby form an array of horizontally spaced apart vertical, columnar explosive charges in the upper zone of unfragmented formation. The array of explosive charges comprises a plurality of vertical columnar central explosive charges 48 in a central portion of the upper zone and a plurality of vertical columnar outer explosive charges 50 surrounding the central charges, i.e., the outer explosive charges are intermediate the planes of the side walls 27 of the voids and the central charges.

Preferably, the outer and central explosive charges are about the same size, i.e., each outer and central explosive charge has about the same diameter and about the same column length and each charge is formed with the same explosive. It is also preferred that the top of each outer and central explosive charge is about the same distance from the upper void 26 as the bottom of each outer and central explosive charge is from the intermediate void 28.

In a preferred form of the exemplary embodiment, therefore, each of the central and outer explosive charges has about the same actual depth of burial. The "actual depth of burial" as used herein is the distance from the free face towards which formation is to be expanded to the center of mass of that portion of an explosive charge that expands formation toward that free face. Thus, for example, the effective center of mass or actual depth of burial of a charge 48 is not at the center of the full column of explosive in the blasthole. In this instance, the charge 48 has two effective centers of mass; one at the center of the upper half of the column of explosive, since the upper half of the column expands formation toward the upper free face 36, and one at the center of the lower half of the column of explosive, since the lower half of the column expands formation towards the lower free face 38.

Additionally, in the exemplary embodiment, each outer and central explosive charge preferably extends through about one-half of the thickness of the upper zone of unfragmented formation. It has been found that having an explosive charge extend through about one-half the thickness of the formation being expanded, and being midway between the free faces towards which the formation is to be expanded, results in the most efficient use of explosive.

It is also preferred that the spacing distance of the outer explosive charges is about equal to the spacing distance of the central explosive charges. The "spacing distance" as used herein is the distance between adjacent explosive charges or blastholes.

If desired, the charges can also be designed and placed into the formation such that each charge has about the same "powder factor". The term "powder factor" as used herein is the ratio of the amount or energy of explosive, used per unit volume of formation explosively expanded, e.g., pounds of ANFO equivalent per cubic yard of formation expanded.

When outer and central explosive charges are provided that are about the same size, have about the same actual depth of burial, and are comprised of the same explosive, then the scaled depth of burial of each of the charges is about the same. Having explosive charges each with the same scaled depth of burial enhances uniform fragmentation of formation and uniformity of void fraction distribution within the fragmented permeable mass formed.

The "scaled depth of burial" (SDOB) as it is used herein is described by B. B. Redpath in an article entitled "Application of Cratering Characteristics to Conventional Blast Design", *Monograph* 1 *on Rock Mechanics Applications and Mining*, Soc. of Min. Eng. and Am. Inst. of Min. Met. and Pet. Eng., New York, 1977. A copy of this article accompanies the application and is incorporated herein by this reference. Briefly, the scaled depth of burial of an explosive charge can be expressed in units of distance over weight to the $\frac{1}{3}$ power or, preferably, distance over energy of explosive to the $\frac{1}{3}$ power. For example, $SDOB = L/W^{\frac{1}{3}}$ with units of millimeters per calorie to the $\frac{1}{3}$ power. The distance, L, referred to as burden distance in the equation for scaled depth of burial, is the actual depth of burial as described hereinabove. The weight or energy, W, of the explosive is the weight or energy of the explosive charge that expands formation toward the free face.

Each outer explosive charge 50 and each central explosive charge 48 comprises two equal portions. The equal portions of each charge are separated by a detonator designated by an "x" that is placed at about the middle of each such charge. The portion of each outer explosive charge above the detonator comprises the upper portion **50*a* of such an outer charge. Each central explosive charge 48 comprises an upper portion 48*a* above its detonator. These upper portions 48*a* and 50*a* are provided for explosively expanding the upper region 32*a* of the upper zone of unfragmented formation toward the upper void 26**.

Additionally, the portion of each outer charge below the detonator comprises the lower portion **50*b* of such an outer charge and each central explosive charge comprises a lower portion 48*b* below its detonator. These lower portions 48*b* and 50*b* are provided for explosively expanding the lower region 32*b* of the upper zone of unfragmented formation downwardly toward the intermediate void 28**.

Although it is preferred that a single detonator is used and is placed at about the middle of each explosive charge, if desired, such a detonator can be located at a different elevation in each charge or more than one detonator can be used. In either case, the top half of each explosive charge expands an upper portion of the zone of unfragmented formation toward its upper free face while the bottom half of each charge expands a lower portion of the zone of unfragmented formation toward its lower free face.

In the exemplary embodiment, the central explosive charges 48 are in rows comprising a square array of charges in a central region of the upper zone of unfragmented formation. In a square array, the distance between adjacent explosive charges is about equal; that is, the spacing distance within the array is uniform. If desired, however, the central explosive charges can be in an array other than a square array.

Additionally, the outer charges 50 are in rows near each side boundary 20 of the retort. Although, in the illustrated embodiment, the distance between each adjacent outer charge is about equal to the distance between each adjacent central charge, other spacings between outer charges can be used if desired.

Preferably, the distance from each outer explosive charge 50 to an adjacent side wall 27 of the upper and intermediate voids 26 and 28 is about equal to the crater radius of one of the equal portions of such an outer explosive charge. The "distance" from an outer charge to a side wall of a void is defined herein as the distance from the center of such a charge to a vertical plane formed by the side wall. The "crater radius" as used herein is defined as the radius of a crater formed by the detonation of an explosive charge toward an effectively infinite free face, i.e., toward a free face that is not confined by vertical walls of unfragmented formation such as the void walls 27. The crater radius of an explosive charge as a function of SDOB for a selected subterranean formation can be estimated theoretically or determined by field testing or the like.

It has been found that when explosive charges are too close to the side walls of a void, the formation expanded by detonation of such an explosive charge is partly directed inwardly toward the center of the retort due to interference between the side walls of such a void and the formation being explosively expanded. This can contribute to mounding of the fragmented permeable mass of formation particles at the center of the retort and, during retorting operations, to gas channeling through high void fraction regions of the fragmented mass along the side boundaries of the retort.

It has, however, been determined that when explosive charges such as the outer explosive charges 50 of the exemplary embodiment are placed at least about one crater radius from the planes of the side walls of the voids, formation expanded by detonation of the charges is not interfered with by the void walls. Therefore, the formation expanded by the outer charges of the exemplary embodiment can be directed substantially vertically toward the horizontally extending free faces with minimal interference from the void walls. It is preferred, therefore, that the outer charges 50 be located about one crater radius from the plane of the side wall of an adjacent void, i.e., about one crater radius from the edge of the adjacent free face. If located less than about one crater radius from the plane of the side wall of the void, the side wall can interfere with expansion and contribute to mounding and/or void fraction maldistribution. If located more than about one crater radius from the plane of the side wall of the void, formation which is not fragmented to a desired extent can remain between the side wall and the lip of a crater formed when such a charge is detonated.

When a plurality of explosive charges are placed in a row, the charges can interact when detonated in a single round. The resulting crater adjacent one such charge can be somewhat broader than the crater formed by an isolated charge. Thus, in some embodiments, the effective crater radius of a row of charges can be somewhat greater than the crater radius when one such charge is detonated separately.

As used herein, therefore, the term "crater radius" can refer to the radius of a crater formed by an individual explosive charge when such a charge does not interact with other charges, or to the radius of a crater formed by an individual explosive charge in a row of interacting charges.

The lower zone 34 of unfragmented formation is prepared for explosive expansion in accordance with principles of this invention as described above for preparation of the upper zone of unfragmented formation.

Thereafter, the explosive charges in the upper and lower zones of unfragmented formation are detonated for explosively expanding the zones of unfragmented formation toward their adjacent voids. The detonation of the explosive charges in the upper and lower zones is preferably in a single round, but, if desired, can be in a plurality of separate rounds. Additionally, the outer and central charges in one or both zones can be detonated simultaneously or in other sequences with time delays between detonations as desired.

Detonation in a single round, as used herein, means detonation of a number of separate explosive charges, either simultaneously or with only a short time delay between separate detonations. A time delay between explosions in a sequence is short when formation explosively expanded by detonation of one explosive charge has either not yet moved or is still in motion at the time of detonation of a subsequent explosive charge.

In the exemplary embodiment, the central and outer explosive charges are detonated in a single round for explosively expanding the upper region **32*a* of the upper zone of unfragmented formation upwardly toward the upper void 26 and for explosively expanding the lower region 32*b* of the upper zone of unfragmented formation downwardly toward the intermediate void 28. Additionally, the central and outer explosive charges formed in the lower zone 34 of unfragmented formation are detonated in the same single round for explosively expanding an upper region 34*a* of the lower zone of unfragmented formation upwardly toward the intermediate void 28 and for explosively expanding the lower region of the lower zone of unfragmented formation downwardly toward the lower void 30. Detonation of the explosive charges and the resulting expansion of the zones of unfragmented formation form the fragmented permeable mass 12 of formation particles in the in situ oil shale retort 10**.

When the outer and central charges formed in accordance with this invention are detonated, vertical expansion of formation toward the voids is enhanced while lateral expansion is inhibited, which will result in the fragmented permeable mass formed having enhanced uniformity of void fraction distribution across horizontal cross-sections of the retort. Additionally, the surface 21 of the fragmented permeable mass of formation particles should be generally flat.

By practice of this invention, therefore, gas channeling along the side boundaries of the retort 10 and consequent bypassing of portions of a fragmented permeable mass of formation particles can be inhibited.

Figure 4:
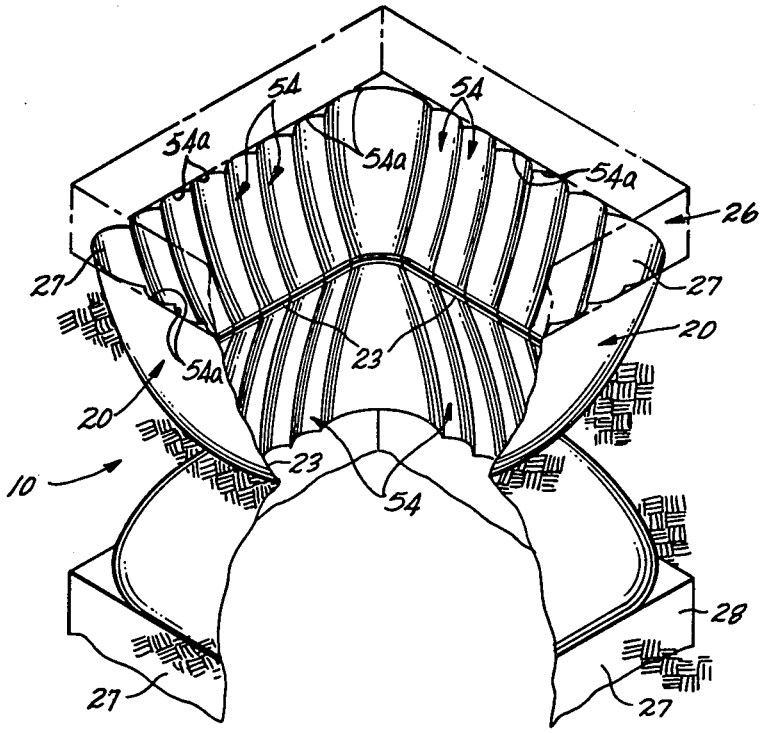
FIG. 4 is a semi-schematic fragmentary perspective view of a portion of the in situ oil shale retort illustrated in FIG. 1.

The shape of the retort formed in accordance with this invention can be further understood by referring to FIG. 4 in addition to FIGS. 1–3.

FIG. 4 is a partly cut-away, semi-schematic perspective view of the portion of the retort 10 formed by explosive expansion of the upper zone 32 of unfragmented formation toward the upper void 26 and toward the intermediate void 28. The fragmented permeable mass of formation particles is not shown within the boundaries of the retort for clarity of illustration.

A portion of each crater 54 formed by detonation of the upper portion **50*a* of each outer charge 50 extends laterally from about the locus of the base of the charge, i.e, about from the detonator, x, toward a side wall 27 of the upper void 26. Each crater extends laterally as far as the wall, only in the vicinity of the juncture of the wall and the locus of the free face 36**.

Collectively, the lips **54*a* of the craters 54** form a slightly scalloped line adjacent the wall of the void. With good interaction between charges in the outer row, i.e., between the outer explosive charges, the line can be essentially straight along the side wall of the retort. A scallop is shown in the drawings for purposes of illustration.

The craters 54 are roughly paraboidal. Collectively, they form a surface on the unfragmented formation that slopes inwardly and downwardly from the vicinity of the upper void 26 and the upper free face 36, and inwardly and upwardly from the vicinity of the intermediate void 28 and the lower free face 38, toward the locus of the center of height of each explosive charge in the row of outer explosive charges.

The side boundaries 20 of the retort 10, therefore, are curved and in the exemplary embodiment have a cuspidal shape. That is, the side boundaries extend downwardly and laterally inwardly from the side walls 27 of the upper void 26 and upwardly and laterally inwardly from the side walls 27 of the intermediate void 28 toward the center of the retort. Each side boundary includes a cusp 23 that extends around the entire perimeter of the retort. The cusp forms one narrow waist, i.e., one narrow cross-section, of the retort 10 as shown at line 22 in FIG. 1.

As can be best seen by referring to FIG. 2, the cusp 23 is formed near a plane which defines the juncture of the upper region **32*a* and the lower region 32*b* of the upper zone of unfragmented formation. That is, the cusp is formed in about a plane extending horizontally through the locus of the center of height of each explosive charge in the row of outer charges. The cusp 23 is, therefore, located about half the distance between the upper void 26 and the intermediate void 28**.

The fragmented permeable mass of formation particles 12 has a smaller horizontal cross-section at an elevation in the retort at about the locus of the cusp and a larger horizontal cross-section at elevations in the retort at about the locus of the upper and intermediate voids 26 and 28.

In the exemplary embodiment, the portion of the retort formed by explosive expansion of the lower zone 34 of unfragmented formation has the same shape as that formed by expansion of the upper zone, as illustrated in FIG. 4. A cusp 25 similar to the cusp 23 is formed about half the distance between the intermediate void 28 and the lower void 30. The cusp 25 extends around the entire perimeter of the retort as does the cusp 23.

Therefore, the fragmented permeable mass of formation particles 12 will also have a smaller horizontal cross-section at an elevation in the retort about half the distance between the intermediate void 28 and the lower void 30 and a larger horizontal cross-section at about the locus of the intermediate and lower voids.

As described above, gas channeling along the side boundaries of the retort 10 formed in accordance with practice of this invention can be inhibited because of enhanced uniformity of void fraction distribution of the fragmented mass formed therein. Additionally, even when the void fraction of the fragmented mass is slightly higher along the side boundaries of the retort than in the center, gas flow across the horizontal extent of the retort can be reasonably uniform. This is because the effect of channeling along the curved or cuspidal-shaped side boundaries of the retort is minimized due to the increased length of the gas flow path along such side boundaries compared to the flow path through the center of the retort.

Figure 5:
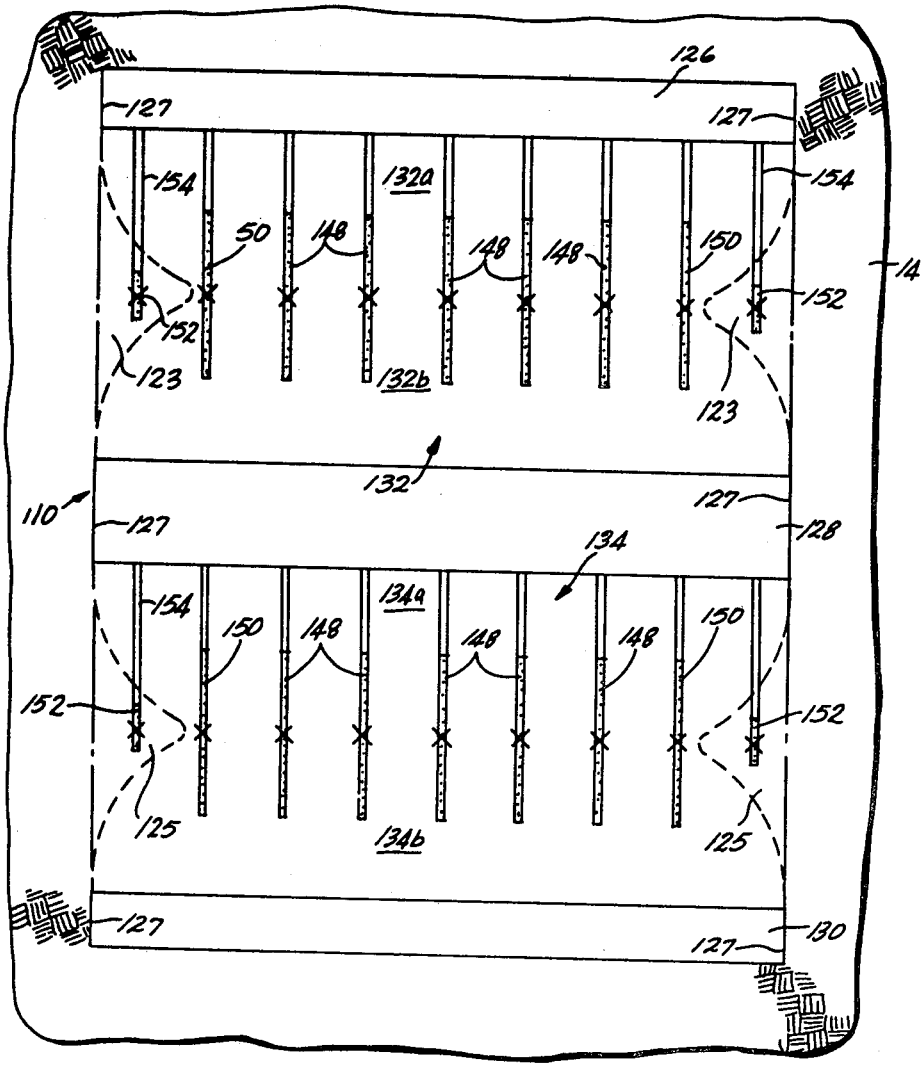
FIG. 5 is a semi-schematic vertical cross-sectional view showing a portion of a subterranean formation containing oil shale at one stage during preparation for explosive expansion for forming another in situ oil shale retort in accordance with this invention.

Referring to FIG. 5, there is shown a semi-schematic vertical cross-sectional view of another exemplary embodiment of a retort 110 being formed in accordance with practice of this invention. The retort 110 being formed is similar to the retort 10 shown in FIG. 1 except that in this embodiment at least a portion or all of the unfragmented formation which forms the narrow waist, i.e., the cuspidal-shaped segments of formation, is also explosively expanded. The retort of this embodiment, therefore, has side boundaries which extend more vertically than the side boundaries of the retort 10.

Upper and lower zones 132 and 134 of unfragmented formation are loaded with a plurality of outer and central explosive charges 150 and 148, respectively, as were the upper and lower zones 32 and 34 of the above described exemplary embodiment.

In addition, a plurality of auxiliary explosive charges 152 are formed in blastholes 154 drilled into the cuspidal-shaped segments 123 and 125 of unfragmented formation being formed.

The auxiliary explosive charges extend around the perimeter of the retort and are closer to the planes of the side walls 127 of the voids than are the outer charges. The distance between adjacent auxiliary charges and the distance between the row of auxiliary charges and the row of outer charges are selected so that there is a desirable amount of interaction between the charges to explosively expand a selected portion or all of each cuspidal-shaped segment as desired.

Preferably, the auxiliary explosive charges each have about the same scaled depth of burial as each of the outer and central charges for enhancing uniformity of fragmentation. Since each auxiliary charge can have less formation to expand than each of the outer or the central charges, each auxiliary charge is smaller, i.e., less energetic, than each outer or central charge.

The outer and central explosive charges in each zone are detonated first for explosively expanding an upper region **132*a* of the upper zone toward the upper void 126 and a lower region 132*b* of the upper zone toward the intermediate void 128. Additionally, detonation of the explosive charges explosively expands an upper region 134*a* of the lower zone toward the intermediate void 128 and a lower region 134*b* of the lower zone toward the lower void 130**.

After a time delay sufficient to form a new cuspidal-shaped free face defining the cuspidal-shaped segments 123 and 125, the auxiliary charges 152 are detonated for explosively expanding at least a portion of such cuspidal-shaped segments. By explosively expanding a portion of the cuspidal-shaped segments which form the narrowed waists in the retort, the extent of increase in gas flow path length along the side boundaries can be diminished, while gas flow resistance along the side boundaries remains high to minimize channeling. The quantity of oil shale retorted can also be increased in such an embodiment.

Although, in the exemplary embodiments described above, both the upper and lower zones of unfragmented formation are loaded with explosive for providing outer charges about one crater radius from the void walls, it may be desirable to load only one of the zones with charges having such a configuration. If desired, a different configuration of explosive charges can be used in the other zone.

In another exemplary embodiment, only one void is excavated into the subterranean formation and a zone of unfragmented formation is left above the void. The zone of unfragmented formation is then explosively expanded toward the void in a plurality of layers. If desired, the layers can be expanded in a single round or, alternatively, can be expanded in separate rounds or lifts. When separate rounds are used, a portion of formation expanded from a previous round can, if desired, be removed from the void before expansion of the next layer.

Each layer of the zone of unfragmented formation being expanded has an array of explosive charges formed therein. If desired, the upper layer, i.e., the last layer expanded, can contain a plurality of outer explosive charges located in the formation, as described for the exemplary embodiments above. Preferably, the outer charges are located in the upper layer about one crater radius from the planes of the vertical side walls of the void, while no charges are intermediate the outer charges and the planes of the side walls.

This results in a retort that has a smaller cross-sectional area at its top than at other elevations.

In yet another exemplary embodiment, two voids can be formed in the unfragmented formation and a zone of unfragmented formation is left between the voids. A bottom portion of the zone of unfragmented formation can be explosively expanded in one or more layers toward the lower void, while the topmost or upper layer of unfragmented formation is expanded both upwardly toward the upper void and downwardly toward the lower void. In this case, if desired, the topmost or upper layer can contain a plurality of outer explosive charges located in the formation, as described for the exemplary embodiments above. The outer charges are preferably located in the topmost layer about one crater radius from the planes of the vertical side walls of the voids, while no charges are intermediate the outer charges and the planes of the side walls.

This results in a retort being formed that has a cuspidal-shaped segment having a cusp located around the perimeter of the retort about midway between the top and bottom of the topmost layer of unfragmented formation.

Additionally, although in the above described embodiments, outer charges are around the entire perimeter of the blasthole pattern at about one crater radius from the vertical planes of the side walls of the voids, if desired, outer charges can be about one crater radius from only one or any portion of the planes of such side walls.

The above description of a method for forming retorts in accordance with this invention is for illustrative purposes. Because of variations which will be apparent to those skilled in the art, the present invention is not intended to be limited to the particular embodiments described above. The scope of the invention is defined in the following claims.

What is claimed is:

1. An in situ oil shale retort in a retort site in a subterranean formation containing oil shale, the retort comprising:

top, bottom, and side boundaries of unfragmented formation, wherein each such side boundary includes a cusp of unfragmented formation at an intermediate elevation in the retort site, the cusps of each such side boundary when taken together provide a cuspidal-shaped segment of formation that extends around the entire perimeter of the retort at the intermediate elevation to thereby provide such a retort with a horizontal cross-sectional area at the intermediate elevation that is less than the horizontal cross-sectional area of the retort at elevations above and below the intermediate elevation; and a fragmented permeable mass of formation particles contained within the top, bottom, and side boundaries of the retort extending through the intermediate elevation from elevations above and below the intermediate elevation.

2. An in situ oil shale retort in a retort site in a subterranean formation containing oil shale, the retort comprising:

a top boundary of unfragmented formation; a bottom boundary of unfragmented formation;

side boundaries of unfragmented formation, wherein each such side boundary includes a cuspidal-shaped segment of unfragmented formation extending inwardly into the retort at an intermediate elevation in the retort site to thereby form a narrow waist around the entire perimeter of the retort at said intermediate elevation; and a single fragmented permeable mass of formation particles containing oil shale within such top, bottom, and side boundaries of the retort, the fragmented mass extending through the intermediate elevation from elevations above and below the cuspidal-shaped segments.

* * * * *